US005122229A

United States Patent [19]

Seifert

[11] Patent Number: 5,122,229

[45] Date of Patent: Jun. 16, 1992

[54] APPARATUS AND METHOD FOR WASHING CELLULOSIC PULP

[75] Inventor: Peter Seifert, Middletown, Ohio

[73] Assignee: The Black Clawson Company, Middletown, Ohio

[21] Appl. No.: 649,103

[22] Filed: Feb. 1, 1991

Related U.S. Application Data

[63] Continuation-in-part of Ser. No. 474,887, Feb. 5, 1990, abandoned.

[51] Int. Cl.[5] ..... D21C 9/02

[52] U.S. Cl. ..... 162/60; 162/61; 162/198; 162/DIG. 10

[58] Field of Search ..... 162/60, 49, 61, DIG. 10, 162/198; 210/772, 783, 400, 401, 386, 210, 216, 137, 739; 68/181 R, 205 R, 158

[56] References Cited

U.S. PATENT DOCUMENTS

| | | | |
|---|---|---|---|
| 3,930,206 | 2/1976 | Stranger-Johnnesen | 162/60 |
| 4,096,028 | 1/1978 | Rosenberger | 162/49 |
| 4,154,644 | 6/1979 | Ericsson | 162/60 |
| 4,217,170 | 7/1980 | Luthi | 162/380 |
| 4,732,651 | 3/1988 | Lisnyansky et al. | 162/49 |

OTHER PUBLICATIONS

Ericsson et al., "Operating Experience with a New Horizontal Brownstock Washer"-TAPPI Journal Jul. 1983, pp. 43-45.

Sande et al.—"Automated Control of Washer Shower Water at ITT Rayonier"—TAPPI Journal, Mar., 1988, pp. 93-97.

*Primary Examiner*—Karen M. Hastings
*Assistant Examiner*—Brenda Lamb
*Attorney, Agent, or Firm*—Biebel & French

[57] ABSTRACT

In a flat bed, Fourdrinier-type, countercurrent washer for pulp, the opportunities for the development of foam are minimized by "wet" operation of the washer so that the pulp mat remains essentially full of liquid as it passes from each washing zone to the next. Special provision is also made for compensating for drainage at too slow a rate in one washing zone by bypassing some of the flow of washing liquid to that zone so that it is delivered to the zone upstream therefrom. An additional feature is the provision of controls over the flow of drained liquid from one or more of the receptacles therefor so that any solid particles floating on the top of that liquid in the receptacle are delivered to the countercurrent flow which ultimately reaches the evaporator.

10 Claims, 2 Drawing Sheets

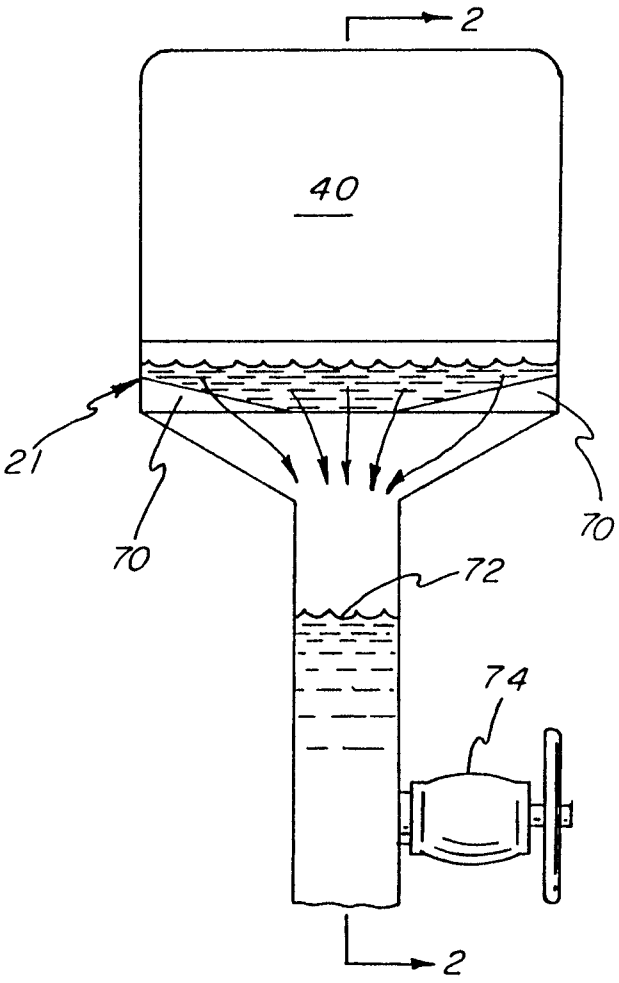
FIG-3
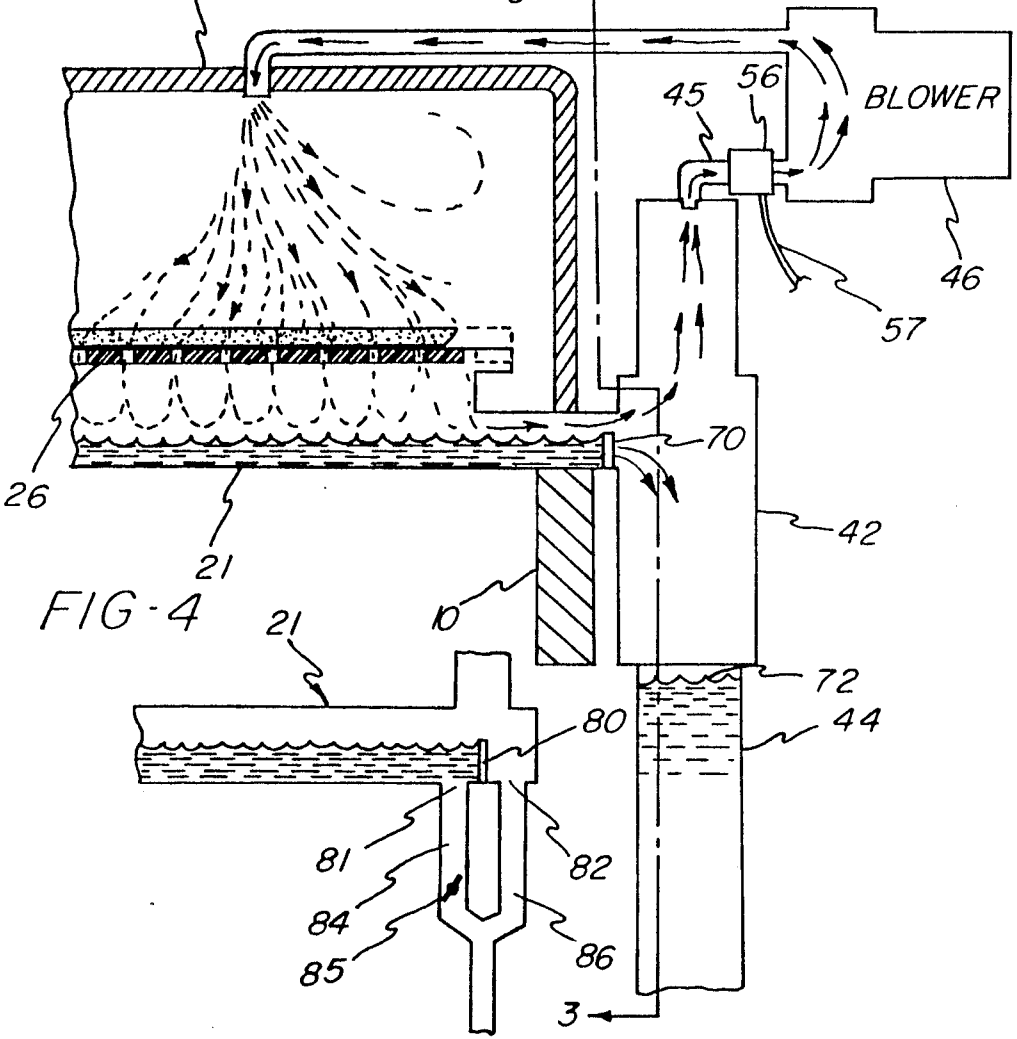
FIG-2
FIG-4

APPARATUS AND METHOD FOR WASHING CELLULOSIC PULP

This application is a continuation in part of Ser. No. 474,887, filed Feb. 5, 1990 now abandoned.

BACKGROUND OF THE INVENTION

In the preparation of cellulosic pulp for use in the manufacture of paper, a common process includes the digesting of wood chips in pulping liquor to break down the pulp into individual fibers and bunches of fibers by dissolving the substances, such as lignins, which bind the fibers together. The spent pulping liquor will therefore contain such dissolved substances and spent chemicals, and the next stage in the preparation of the pulp is a washing stage for the purpose of separating the fibers from the liquor, and also of recovering whatever products of value remain in the liquor.

The art has proposed a variety of types of washers for use in this stage of the preparation of paper making fiber. One type of such apparatus is a flat bed washer which is generally similar in construction and mode of operation to a Fourdrinier paper machine, in that it incorporates an endless foraminous belt ("wire"), a headbox which delivers the pulp suspension in liquor to one end of the horizontally traveling upper run of the wire, successive washing zones along the length of this run, and means at the downstream end of the run for receiving and removing the resulting washed pulp. Pulp washers of this type manufactured by the assignee of the present invention in accordance with Ericsson U.S. Pat. No. 4,154,644 of 1979 have been notably successful, and the present invention was developed to improve the operation and results obtained by such pulp washers.

In the operation of a pulp washer of the Ericsson patent type, the suspension of digested pulp from the digesting system is diluted to a sufficiently low consistency, e.g. 1.5 to 3%, and deposited on the upstream end of the wire run where a mat is formed as the liquid drains through the wire and is recycled to dilute more of the suspension to be washed. Commonly the solids content of this mat is of the order of 8 to 10% at the end of the initial drainage step.

The remainder of the wire run downstream from the mat-formation zone is divided into a series of washing zones to which washing liquid is supplied from above for drainage through the mat and the wire. Fresh washing liquid is supplied to the last of these washing zones, at the downstream end of the wire run, the liquid drained from that last zone is collected and delivered to the washing zone immediately upstream from the final zone, and these steps are repeated for each of the other zones to effect countercurrent washing of the pulp mat as it progresses from the formation zone to the discharge end of the washer, while the filtrate from the first washing zone may be sent to an evaporator station for removing of its dissolved constituents.

The operation of a pulp washer of this type may therefore be described as being according to the displacement washing principle. That is to say, once the pulp mat has been formed, it is not rediluted but simply is subjected to repeated washings by application on top of the mat of washing liquid with the liquid applied in each washing zone having a lower concentration of liquor than the filtrate from the preceding zone. The liquid applied in each zone enters the mat substantially en masse and thereby displaces the liquid which was carried into the zone in the mat and causes it to drain therefrom through the wire.

Among the mechanical elements of a washer according to the Ericsson patent is a hood which encloses the entire apparatus downstream from the headbox, and a series of receptacles below the operating run of the wire and in sealed relation with this hood. In operation, vacuum is applied to these receptacles, and/or gas pressure is developed within the hood, to augment the action of gravity in forcing the washing liquid through the pulp mat on the wire, and one of the features disclosed in the Ericsson patent is the recycling of gases and vapors drawn through the wire into the upper spaces in the receptacles back to the hood to increase the pressure differential above and below the wire.

As already noted, pulp washers in accordance with the Ericsson patent have been outstandingly successful in practical operation, but the extent of their success has varied depending upon the characteristics of the wood pulp with which they are used. More specifically, for pulps which contain a relatively large proportion of soapy constituents, such particularly as Southern Pine Kraft, these constituents promote the development of an undesirable large amount of foam which tends to interfere with proper drainage of liquid through the pulp mat, particularly in the washing zones closest to the formation zone where these soapy constituents are supposed to be washed out of the pulp, and which also creates problems if it is drawn into the vacuum system.

The drainage problem which these soapy constituents cause, and which the present invention was developed to correct, is believed to result from the fact that the foam created thereby exists in the form of many bubbles of air or other gas in soap skins that interrupt the otherwise contiguous gas spaces in a porous pulp mat. It appears that these soap skins are similar to the skins of soap bubbles, and that they anchor themselves on the fibers and span the gaps therebetween through which drainage could otherwise occur, with the end result that the drainage flow is limited to paths around these skins, and the rate of this flow is correspondingly reduced.

SUMMARY OF THE INVENTION

In accordance with the present invention, it has been determined that the problems outlined above which result from the presence of soap-like foam in the pulp mat on a flat top type pulp washer can be substantially reduced, to the point of practical elimination, if the washing and draining conditions are controlled to prevent foam bubbles from entering or otherwise becoming attached to the mat. More specifically, it has been conventional in the operation of this type of pulp washer to cause the drainage of each washing zone to proceed until a "dry line" appeared on the surface of the mat. As explained in the Ericsson patent, this would signify that the level of freely draining liquid in the mat had fallen below the top of the mat.

In contrast, in accordance with the present invention, drainage should be so controlled that no dry line appears, namely by maintaining the mat sufficiently full of liquid to prevent the entry of gases or vapors which could combine with soap in the mat to form foam bubbles that would interfere with proper washing and drainage in the next washing zone. In other words, if all open spaces between fibers in the mat are kept filled with liquid, gas and foam skins cannot enter the mat.

Necessarily, operation in this "wet" manner requires that the amount of liquid transported downstream from each washing zone to the next be higher than with conventional "dry line" operation. More specifically, the appearance of dry lines in conventional operation is an indication that a certain consistency has been reached at the end of a given washing zone. For example, if that consistency is 10%, then for preferred conditions of "wet" operation, it will be less than 8%.

This in turn means that the amount of liquid transferred from each washing zone to the next will be higher than with conventional "dry" operation, but the net increase in the amount of liquid to be handled by the pumping system is not sufficient to cause a significant increase in the power requirements. Further, any increase which may develop in the power required for pumping liquid will be offset by the decrease in the power required to handle gas and possibly foam drawn through the mat in conventional operation.

Since dry lines provide a visual indication of pulp mat consistency, some other means are needed for judging "wet" operation of the washer. One procedure for accomplishing this purpose in an intermediate washing stage is to monitor the drainage flow from each washing zone upstream from the last washing zone, and to make provisions for maintaining those flows as nearly equal as possible. For example, if that flow varies from a desired rate, this can be corrected by adjusting the negative pressure effective on the mat in the washing zone immediately upstream of the zone where the variation is detected.

Successful use of this procedure is facilitated by the fact that the operation of a washer in accordance with the Ericsson patent employs the displacement washing principle, as summarized above, combined with countercurrent washing. In principle, therefore, if the supply of washing liquid flowing to each zone is substantially balanced with the drainage flow of filtrate from that zone at a rate which keeps the mat full of liquid, foam cannot enter the mat, and the washing conditions will remain constant in each zone.

In one mode of operation, this principle may be put into practice by providing a selectively operable valve bypass connection from the wash liquid supply line for each washing zone to the adjacent washing zone upstream thereof. Thus whenever the drainage flow from any one washing zone decreases in rate below the rate at which wash liquid is being supplied to that zone, the initial result would be that washing liquid would accumulate in this "slow" draining zone, and that in turn would reduce the amount of wash liquid available for supply to the zone adjacent the slow zone on the upstream side. This condition is corrected or compensated for in accordance with the invention by activating the bypass connection to cause sufficient wash liquid to bypass the slow zone until the supply flow to and drainage flow from that zone has been brought into balance.

While wet operation, in accordance with the invention, successfully disposes of the foam problem outlined above, it does not affect another problem occassioned by the presence of soapy constituents in the spent liquor, namely the precipitation of dissolved soaps as small particles which form a scum on top of the drained liquid in one or more of the receptacles (suction boxes) below the wire, particularly in the formation zone and the first washing zone where the filtrate contains the highest concentrations of dissolved solids.

In the conventional practice with washers built in accordance with the Ericsson patent, the outlet from which liquid is circulated to the next washing zone is at the bottom of the receptacle. As a result, solid materials floating on the top of the liquid in the receptacle will accumulate there and build up until it is drawn into the system by which gases are removed from the space between the liquid level and the perforate top of the receptacle where it is converted into foam.

This problem is overcome in accordance with one embodiment of the invention by providing a weir or similar device in each receptacle in such position and of such height that all liquid flowing to the outlet must flow over this weir and thereby carry with it the top layer of liquid and any particles floating thereon. Thus any soaps or other impurities which float on the liquid are progressively moved upstream until they either are redissolved in the more concentrated liquor near the headbox end of the wire or reach the receptacle which discharges to the evaporators or other recovery system wherein the concentrated liquors are treated.

In an alternative embodiment, one or more of the receptacles is provided with a weir adjacent but spaced from its outlet end and also with a liquid outlet from a location in its bottom on the inner side of the weir. In normal operation, the flow of drained liquid from the receptacle is controlled to maintain liquid in the receptacle to a depth below the top of the weir. Soaps or other impurities which float on that liquid are then removed from the receptacle from time to time by temporarily throttling the flow of liquid until the level in the receptacle has risen enough for the surface layer of liquid to overflow the weir and thereby to carry with it whatever is floating on the surface.

Other features and advantages of the invention, and specific means by which they are provided or achieved, will be apparent from or pointed out in the course of the detailed description of the preferred embodiment of the invention which follows.

BRIEF DESCRIPTION OF THE DRAWINGS

FIG. 2 is a sectional view on a larger scale taken as indicated by the line 2—2 in FIG. 1 and FIG. 3;

FIG. 3 is a section on the line 3—3 in FIG. 2; and

FIG. 4 is a fragmentary view similar to FIG. 2 showing a modified arrangement for eliminating impurities floating on the liquid in a drainage receptacle in the apparatus of FIG. 1.

DESCRIPTION OF PREFERRED EMBODIMENTS

Figure 1:
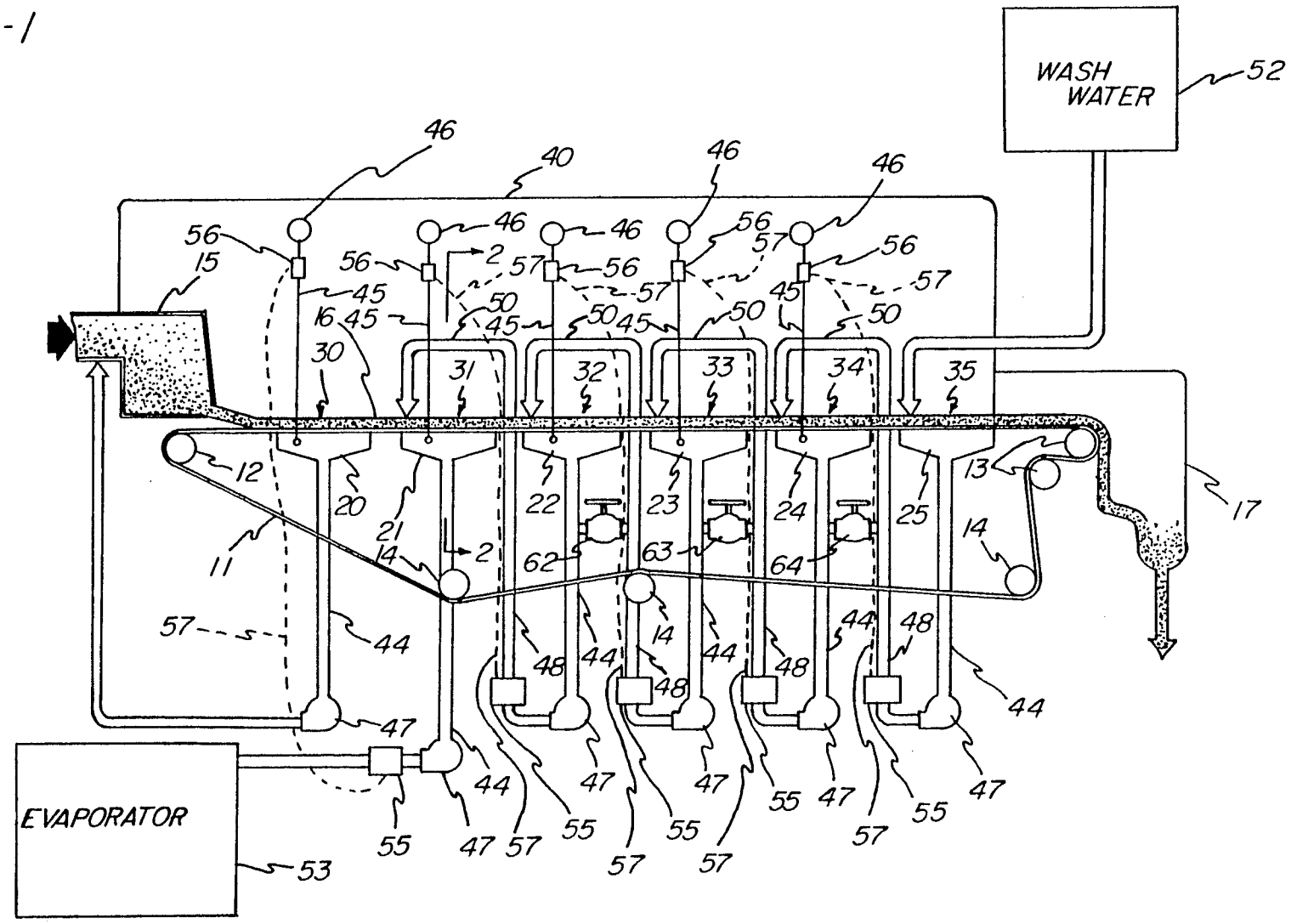
FIG. 1 is a schematic view in side elevation illustrating pulp washing apparatus constructed to operate in accordance with the invention.

In the drawings, a frame indicated generally at 10 supports an endless foraminous belt 11, usually a "wire" of woven plastic filaments, in a loop including a substantially horizontal upper run on a breast roll 12 at the upstream end of the upper wire run, drive rolls 13 at the downstream end of the run, and return and tensioning rolls 14. A headbox 15 deposits the pulp suspension to be washed on the upstream end of the wire run, and as this liquid drains through the wire, a mat 16 of pulp is formed on the wire. This mat passes through a series of washing zones, and the washed pulp mat 16 is discharged from the downstream end of the wire run into any suitable collector 17 from which it is conveyed to the next station in the stock preparation system.

Mounted on the frame 10 immediately below the upper run of wire 11 is a series of receptacles 20–25, each of which is in effect a suction box having a perforate cover 26 of low friction material that supports the portion of the wire run passing thereover. The receptacles 20–25 are connected and operated so that they define a series of successive zones along the path of the belt run comprising a formation zone 30 adjacent the headbox 15 and consecutive washing zones 31–35, the last of which is adjacent the downstream end of the wire run.

A hood 40 is supported by the frame 10 in enclosing relation with all of the zones 30–35, and as shown in FIG. 2, the sides of the hood 40 are in effectively sealed relation with the covers of the receptacles 20–25 outside their perforate portions. At one side of the apparatus, each of the receptacles projects sufficiently beyond the side of the hood 40 to connect with a manifold 42 from which a depending pipe 44 receives liquid accumulating in the receptacle. As is explained in the above Ericsson patent, the level of liquid in each of receptacles 20–25 is controlled to provide space between the liquid and the wire for gases and vapors, and a pipe 45 leads upwardly from this space to a vacuum system, represented by a blower 46, which applies suction to this space to drain liquid through the mat 16 and the wire into each of the receptacles 20–25. Gases and vapors which accumulate in this space are properly recirculated to the interior of the hood 40 above the wire 11.

Each of the receptacles 20–25 may, and usually does, comprise a plurality of individual suction boxes coupled to act together, but for simplicity and clarity, they are represented by single receptacles in FIG. 1. The liquid drain line 44 from each of the receptacles 22–25 leads to a pump 47 from which a discharge line 48 leads to a liquid discharge system, represented by a shower pipe 50, above the adjacent washing zone on the upstream side thereof. Thus the discharge line 48 from the last washing zone 35 leads to zone 34, and so forth and the operation comprises a series of alternate flooding and dewatering steps, with the shower pipes 50 at the upstream of each of the washing zones, constituting the flooding means while the successive suction receptacles 20–25 constitutes the dewatering means.

At the downstream end of the apparatus, the final washing zone 35 is supplied with fresh wash liquid from any suitable source 52 such, for example, as white water from a pulp or paper machine elsewhere in the mill. The filtrate drained through receptacle 25 will therefore have the lowest concentration of liquor, and with the piping providing for countercurrent washing, the filtrate from washing zone 31 will have the highest concentration of liquor.

The discharge line 48 from receptacle 21 should therefore preferably lead to the usual evaporator 53. The filtrate from the forming zone 30 will be undiluted liquor, and it is therefore piped back to the inlet side of the headbox 15 to dilute the incoming suspension to be washed. It is also a common practice to combine the filtrates from the formation and first washing zones, and to send to the evaporator only that portion of the combined filtrates which is not needed for dilution purposes at the headbox.

As described up to this point, the construction and mode of operation of the washing apparatus in FIG. 1 are the same as washers marketed by the assignee of this invention under the Ericsson patent with which difficulties may develop in washing pulp having a soap content, such particularly as Southern Pine Kraft pulp. The present invention provides a number of improvements in structure and mode of operation which successfully disposes of such difficulties, as now described.

As noted in the foregoing "Summary of the Invention" section, the development of the present invention derived in part from the discovery that foam within the pulp mat, which is detrimental to proper washing and drainage, is the result of gas or air having been drawn into the interstices of the mat. The invention has the dual purpose of minimizing the development of conditions permitting gas or air to be drawn into the mat, and also of correcting the interference with proper washing and draining conditions which is caused when foam does develop in the mat.

As also noted above, it has been conventional in the operation of flat bed type pulp washers to control the operation by causing the drainage from each washing zone to proceed until a "dry line" appeared on the surface of the pulp mat, which would signify sufficient removal of liquid from that zone to permit air or gas to enter the mat. It is believed, however, that when this relatively dry mat enters the next washing zone and is showered with wash liquid from above, mixing of the washing liquid with air bubbles within the mat promotes the creation of foam, which in turn reduces free drainage from that washing zone. In other words, the appearance of a dry line is an indication of the consistency of the pulp mat, and analysis of past practice indicates that dry lines will develop when the solids content of the mat rises above approximately 7%.

In accordance with the present invention, it has been determined that if the consistency of the pulp mat is prevented from increasing to the dry line level, e.g. a preferred range of 5 to 10% in comparison with the conventional 10 to 14%, the higher volume of liquid in the mat prevents, or at the least minimizes, the entry of gas and air, and therefore the development of foam. These consistency figures may vary depending upon the type of pulp being washed, but in general, appropriate standards can be established by first estimating the approximate discharge consistency of the washed pulp from the last washing zone.

This discharge consistency can be substantially higher than in each of the other washing zones because even if gas does enter the pulp in this zone, any foam that it creates will be eliminated as the pulp is discharged from the wire around the couch or upper drive roll 13. Based on that assumed discharge consistency, it can readily be determined what supply flow is needed to the washing zone 34 to maintain the appropriate consistency for the pulp transferring to zone 35, and that figure will in turn establish the appropriate supply flow rate of fresh washing liquid to zone 35.

In order to be certain that the desired foam-preventing low consistency values be maintained throughout the preliminary washing zones, the liquid flows from each of the other washing zones should be monitored to assure that they remain substantially in balance, and particularly to assure that throughout each of the washing zones, the pulp mat will retain sufficient liquid to minimize the possibility that air and gas will enter the mat and cause foam to develop therein.

In the preferred practice of the invention, this mode of operation is carried out with the aid of a flow meter 55 of standard construction in the discharge line 48 from each pump 47, and a vacuum control valve 56 in the pipe 45 leading to each blower 46. The control valves 56 can be operated manually on the basis of visual reading of the associated flow meter 55, but preferably each flow meter will be connected to operate its associated vacuum control valve, as indicated by the broken line 57 in FIG. 1.

More specifically, in initially setting up the apparatus for operation, a desired rate at which the fresh washing liquid is supplied to zone 35 is determined. This requires that the filtrate flow from zone 35 be calculated from the sum of the liquid carried into zone 35 with the pulp plus the added washing liquid and minus the liquid retained with the discharged washed pulp. This discharged pulp is normally of higher consistency than the pulp entering zone 35, so that the filtrate flow from zone 35 is correspondingly higher than the fresh liquid supply flow to zone 35.

This filtrate flow from zone 35 becomes the supply flow to zone 34, and it should be maintained through the successive upstream stages as the countercurrent washing proceeds to and from zone 31. As already noted, these flow rates should, according to the invention, be at a level which will assure that the pulp mat in each of zones 31–34 will be maintained full of liquid to minimize the possibility of gas entering the mat.

This requirement, however, does not necessarily apply to the final washing zone 35, both because it is most improbable that any foam-producing constituents will still be in the mat at that end of the wire run, and also because, as already noted, any gas bubbles which may enter the mat as it leaves zone 35 will be forced out as the mat falls off as the wire wraps the couch roll.

As an example of typical operation in accordance with the invention, the first step is to establish a desired "dry" consistency for the pulp mat 16 as discharged from the wire 11 following passage through the washing zone 35, e.g. 12% solids, which means that for each metric ton of oven dry pulp leaving the zone 35, there will be 7,333 kilograms of water. It is also advantageous to establish a desired dilution factor for the washing zone 35, and for the purposes of this example the dilution factor is assumed to be 1, which is adequate for the washer of this invention because it operates on the displacement washing principle. This dilution factor means that for each metric ton of dry pulp, 8,333 kilograms of wash water should be supplied to the zone 35 from the source 52.

Proceeding from these premises on the assumption that "wet" pulp in the context of the invention requires a consistency which does not exceed 7%, then there must be at least 13,286 kilograms of water of each metric ton of dry pulp in the mat 16 entering zone 35 from zone 34. This in turn means that the drainage flow from zone 35 must be at a rate which corresponds to $13,286+8,333-7,333$ or a total of 14,286 kilograms per metric ton of dry pulp.

This information is used in the practice of the invention by the flow meter 55 in the line 48 leading to washing zone 34, which monitors the flow therethrough and preferably, as indicated by the broken line 57, adjusts the valve 56 in the vacuum line from receptacle 24 for zone 34. More specifically, since the principles of the invention require that the mat 16 passing from zone 34 into zone 35 be of a "wet" consistency of not more than 7%, the vacuum in receptacle 24 should be controlled to maintain a water content of the mat leaving zone 34 of at least 13,286 kilograms per ton of dry pulp as calculated above. Such control may be by manual adjustment of the valve 56, based on observation of the flow meter 55, but automatic adjustment by the flow meter is preferred.

The same calculations show that to maintain the desired dilution factor and the desired "wet" consistency of the pulp mat 16 as it passes through the zone 34, there will be 13,286 kilograms of water for each ton of pulp entering the zone 34, and the drainage from zone 35 supplied to zone 34 should therefore equal 14,286 kilograms per ton of pulp. Further, because the wash water supplied to zone 34 consists entirely of drainage from zone 35, and since the rate at which fresh water is supplied to zone 35 is maintained at a fixed level, the balance of the drainage from zone 35 comprises water drained from the pulp mat 16 entering zone 35. It is therefore necessary to control the drainage from zone 34 so that it does not exceed the desired rate, because that could change the "wet" consistency of that pulp mat to an undesired "dry" consistency.

Accordingly, the flow meter 55 between zones 35 and 34 is set to maintain the desired flow rate of 14,286 kilograms per metric ton of pulp, and if it detects an increase or decrease in the flow from that desired rate, it responds by adjusting the vacuum in receptacle 24 to establish a drainage rate into the receptacle 24 which will assure that the pulp mat 16 will have a desired "wet" consistency as it leaves zone 34. The same conditions apply to each of the washing zones upstream from zone 34 as well as the forming zone 30, each of which has its own flow meter 55. It will also be apparent that the travel rate of the mat 16 on the wire can readily be converted into kilograms per minute, and the flow rates of the fresh wash water and the recycled filtrate from each washing zone can be similarly converted to kilograms or liters per minute.

Procedure in this manner will generally be successful in preventing the development of foam and thereby in maintaining the system in balance throughout the full set of washing zones. If, however, an out of balance condition should occur, whether from the development of foam or otherwise, the invention provides for disposing of such problems by means of selectively operable connections by which filtrate from a washing zone where the drainage rate is slower than desired will be caused to bypass the adjacent zone if the drainage conditions in that adjacent zone are such that the rate of drainage therefrom is less than the rate at which fresh washing liquid is being supplied to the last washing zone 35.

As shown in FIG. 1, a bypass connection including a selectively operable valve 62 is connected between the supply line 48 to zone 32 and the drain line 44 from zone 32. Similar bypass valves 63 and 64 are connected between the supply and drain lines for zones 33 and 34 respectively. These bypass valves are normally closed so long as the supply and drain rates for each washing zone are in balance and the operation of the washer is stable. No bypass connection around zone 31 is needed, because the filtrate from the first washing zone goes to the evaporator.

If, however, by reason of the accumulation of foam or for any other cause, the drainage rate from any of zones 32–35 should decrease below the rate at which wash liquid is supplied to that zone, for example the zone 33, the resulting back-up of wash liquid in zone 33 will correspondingly reduce the rate at which wash liquid is supplied to zone 32. In addition, since the pulp mat is continuously advancing on the wire, the pulp entering zone 34 will be of lower consistency than desired, and the extra liquid therein could upset the normal balance between the wash liquid supply to and the filtrate flow from zone 34.

To correct these conditions, the bypass valve 63 is opened to the extent necessary to divert enough of the filtrate from zone 34 directly to zone 32, bypassing zone 33. This bypassing operation can be continued as long as it is needed, until either the "slow" drainage condition in zone 33 corrects itself, or the system has been stabilized by otherwise balancing the rates of supply flow and drainage for each station. The selective operation of bypass valves 62–64 may be manual, based on observation of the flow meters 55, or by a control system similarly responsive to the supply and drainage flow rates for the washing zones 32–34 to maintain those flows in balance as explained above.

Another soap problem successfully dealt with by the invention derives from that fact that when the concentration of dissolved solids in the filtrate is high, as is the normal case in the formation zone 30 and first washing zone 31, the soap tends to precipitate in the form of small particles which form a scum that floats on the filtrate in the receptacle 20 and/or receptacle 21. When the outlet from the receptacle to the drain line 44 is at the level of the bottom of the receptacle, and when a liquid level above the bottom of the receptacle is maintained as recommended in the Ericsson patent, any such scum tends to accumulate on top of the liquid in the receptacle until there is enough for some to be drawn into the vacuum system, which can overload or otherwise damage the fans.

Referring to FIGS. 2 and 3, this problem is successfully disposed of according to the invention by providing a weir at the outer end of the receptacle over which filtrate initially accumulating in the receptacle must flow in order to reach the outlet to drain line 44, and also by maintaining the liquid in the associated drain line at a level spaced below the bottom of the receptacle. This weir may be a wall of uniform height extending across the end of the receptacle, or, as shown in FIG. 3, it may comprise a pair of oppositely inclined walls 70 extending across the open end of the receptacle 21. This arrangement forces the liquid in the receptacle to fall through a space in the upper portion of the line 44 before it reaches the liquid level 72 at which the liquid is maintained, as by a control valve 74.

The flow of liquid over weir 70 will necessarily include the surface layer of liquid within the receptacle, which will carry with it any soap particles floating on its upper surface. As this freely-falling liquid mixes with the liquid in the drain pipe, the floating particles will be mixed with the liquid sufficiently to be entrained in the flow which ultimately reaches the evaporator.

With this arrangement and these operating conditions, the filtrate in receptacle 21 will be maintained at a level above its bottom wall 75, but the flow into the manifold 42 will include enough of the upper surface portion of that liquid to carry with it any floating solid particles as it free falls to the liquid level 72 in pipe 44. This provision for disposing of floating scum is normally needed only at the formation and first washing zones, but it can also be incorporated in additional zones if desired.

FIG. 4 illustrates an alternative arrangement for disposing of solids floating on the surface of the liquid in one of the receptacles 21. The outer end portion of this receptacle includes a weir 80, and the bottom wall of the receptacle is provided with one liquid outlet 81 inside the weir 80 and a second outlet 82 outside of weir 80. In normal operation with this embodiment, there will be a continuous flow through the outlet 81 and down through the pipe 84. By means such as the valve 85 shown diagrammatically in FIG. 4, liquid will be maintained in the receptacle 21 at a level above the bottom wall of the receptacle but below the top of the weir 80.

From time to time, as floating solids accumulate on the surface of this liquid in receptacle 21, the valve 85 may be closed to the extent needed to cause the liquid level in receptacle 21 to rise until it overflows the weir 80, carrying with it the accumulated surface layer of solids. This overflow will cascade down the pipe 86, which joins the pipe 84 below the valve 85. This operation can be carried out manually, on the basis of observation of the presence or absence of a surface layer of solids in the receptacle, or it may be effected automatically at periodic intervals.

Since the washing apparatus of the invention was developed for use in the treatment of paper making pulps suspensions, it has been described with specific reference thereto. It is to be understood, however, that the apparatus and method of the invention could be used in the countercurrent washing of other suspensions of solid particles in liquid, such for example as suspensions of ground ore particles, or in the bleaching of paper pulps.

While the methods herein described, and the forms of apparatus for carrying these methods into effect, constitute preferred embodiments of this invention, it is to be understood that the invention is not limited to this precise method and form of apparatus, and that changes may be made in either without departing from the scope of the invention, which is defined in the appended claims.

What is claimed is:

1. Apparatus for washing a suspension of solid particles in liquid, comprising:

(a) a frame including means for supporting an endless foraminous belt in a loop including a substantially horizontal upper run, (b) means for driving said belt run in a single direction, (c) means for depositing the suspension on the upstream end of said belt run for drainage therethrough to form a mat of said particles on said run, (d) means at the downstream end of said run for removing said mat therefrom, (e) means including a plurality of drainage receptacles below and in sealed relation with said belt run which define a corresponding plurality of zones along said run including a formation zone at said upstream end thereof and a plurality of successive washing zones between said formation zone and the downstream end of said belt run, (f) means for alternately flooding and dewatering said mat during passage thereof through each of said zones including means for maintaining a lower pressure in the interior of each of said receptacles than in the space directly above said belt to cause liquid to drain from said mat through said belt run into said receptacles, (g) said flooding and dewatering means also including means for delivering liquid to each of said washing zones from above for displacement washing of the portion of said mat passing therethrough and drainage into said receptacles, (h) means for supplying fresh washing liquid to said delivering means for the one of said washing zones adjacent the downstream end of said belt run, (i) means for conveying drained liquid from each of said receptacles countercurrently with respect to the direction of movement of said belt to said delivering means for the adjacent said washing zone upstream from said receptacle, (j) means for monitoring the flow rate of drained liquid from each of selected said receptacles to detect any variation between said flow rate and the rate of delivery of liquid to the one of said washing zones delivered by said selected receptacle, and (k) means for compensating for any such variation to maintain the liquid content of said mat sufficiently high to minimize the entry of gas into said mat from above.

2. Pulp washing apparatus as defined in claim 1 further comprising control means for controlling said pressure maintaining means for the one of said washing zones immediately upstream of each of said selected receptacles, and wherein said compensating means comprises means for regulating said control means for each of said upstream washing zones.

3. Pulp washing apparatus as defined in claim 2 wherein said compensating means comprises means connected between said monitoring means for each of said selected receptacles and said control means for said immediately upstream washing zone for operating said control means in response to detection of variation by said monitoring means.

4. Pulp washing apparatus as defined in claim 1 wherein said monitoring means comprises flow metering means connected between each of said selected receptacles and the one of said washing zones immediately upstream thereof, and wherein said compensating means comprises means for adjusting said pressure maintaining means for the one of said washing zones immediately upstream of each of said selected receptacles.

5. Pulp washing apparatus as defined in claim 4 further comprising means connected between each of said monitoring means and said control means for said immediately upstream washing zone for operating said control means in response to detection of variation by said monitoring means.

6. Apparatus for washing a suspension of solid particles in liquid, comprising:

(a) a frame including means for supporting an endless foraminous belt in a loop including a substantially horizontal upper run, (b) means for driving said belt run in a single direction, (c) means for depositing the suspension on the upstream end of said belt run for drainage therethrough to form a mat of said particles on said run, (d) means at the downstream end of said run for removing said mat therefrom, (e) means including a plurality of drainage receptacles below and in sealed relation with said belt run which define a corresponding plurality of zones along said run including a formation zone at said upstream end thereof and a plurality of successive washing zones between said formation zone and the downstream end of said belt run, (f) means for maintaining a lower pressure in the interior of each of said receptacles than in the space directly above said belt, (g) means for delivering liquid to each of said washing zones from above for displacement washing of the portion of said mat passing therethrough and drainage into said receptacles.

(h) means for supplying fresh washing liquid to said delivering means for the one of said washing zones adjacent the downstream end of said belt run, (i) means for conveying drained liquid from each of said receptacles countercurrently with respect to the direction of movement of said belt to said delivering means for the adjacent said washing zone upstream from said receptacle, and (j) selectively operable means cooperating with said conveying means from at least one of said receptacles and structurally arranged to bypass said delivering means for the adjacent said washing zone to said delivering means for said washing zone immediately upstream from said adjacent washing zone.

7. Washing apparatus as defined in claim 6 wherein said selectively operable means comprises means for detecting a supply flow of liquid to specific said delivering means for any one of said washing zones greater than the drainage flow from said one zone, and means responsive to said detecting means for causing at least a portion of said greater supply flow to bypass said specific delivering means to said delivering means for the adjacent said washing zone.

8. The method of washing a suspension of solid particles in liquid which comprises the steps of:

(a) depositing the suspension onto the upstream end of a substantially horizontal upper run of an endless foraminous belt while driving said belt run in a single direction, (b) forming a mat of solid particles on said belt by draining the liquor from said deposited suspension through a predetermined portion of said belt run constituting a formation zone, (c) defining a plurality of successive washing zones between said formation zone and the downstream end of said belt run, (d) delivering fresh washing liquid from above onto said mat in the one of said washing zones adjacent the downstream end of said belt run for drainage through said mat and belt, (e) collecting said drained liquid below said one zone and delivering said collected liquid from above onto said mat in said washing zone adjacent the upstream end of said one washing zone for drainage through said mat and belt, (f) alternately flooding and dewatering said mat in each of said washing zones during passage of said mat through successive said zones by repeating said collecting and delivering steps for each of the other said washing zones to effect countercurrent washing of said mat, (g) determining the maximum consistency of said mat at which the liquid content of said mat will be sufficiently high to minimize the entry of gas into said mat from above, and (h) maintaining the flow rates of said collecting and delivering steps for selected said other washing zones substantially equal to each other and to a predetermined value such that said maximum consistency of said mat in each of said other zones will not be exceeded.

9. The method defined in claim 8 further comprising the steps of monitoring said liquid collecting and delivering steps to detect any variation from substantial equality in the flow rates of said collecting and delivering steps for any of said other washing zones, and compensating for any such variation to reestablish said predetermined rate of said collecting and delivering steps for such zone.

10. The method of washing a suspension of solid particles in liquid which comprises the steps of:

(a) depositing the suspension onto the upstream end of a substantially horizontal upper run of an endless foraminous belt while driving said belt run in a single direction, (b) forming a mat of solid particles on said belt by draining the liquor from said deposited suspension through a predetermined portion of said belt run constituting a formation zone, (c) defining a plurality of successive washing zones between said formation zone and the downstream end of said belt run, (d) delivering fresh washing liquid from above onto said mat in the one of said washing zones adjacent the downstream end of said belt run for drainage through said mat and belt, (e) collecting said drained liquid below said one zone and delivering said collected liquid from above onto said mat in said washing zone adjacent the upstream end of said one washing zone for drainage through said mat and belt, (f) repeating said collecting and delivering steps for each of the other said washing zones to effect countercurrent washing of said mat, (g) monitoring said liquid collecting and delivering steps to detect any decrease from a predetermined rate in the rate of drainage from any one of said washing zones, and (h) compensating for such decrease with respect to any such one washing zone by delivering corresponding excess liquid to the washing zone immediately upstream of such one zone from the washing zone immediately downstream from such one zone.

* * * * *